US008122700B2

(12) United States Patent
Donnelly

(10) Patent No.: US 8,122,700 B2
(45) Date of Patent: Feb. 28, 2012

(54) PREMIX NOZZLES AND GAS TURBINE ENGINE SYSTEMS INVOLVING SUCH NOZZLES

(75) Inventor: Brian G. Donnelly, Edenton, NC (US)

(73) Assignee: United Technologies Corp., Hartford, CT (US)

( * ) Notice: Subject to any disclaimer, the term of this patent is extended or adjusted under 35 U.S.C. 154(b) by 1224 days.

(21) Appl. No.: 12/110,424

(22) Filed: Apr. 28, 2008

(65) Prior Publication Data

US 2009/0266079 A1 Oct. 29, 2009

(51) Int. Cl.
*F02C 9/16* (2006.01)
*F23R 3/26* (2006.01)

(52) U.S. Cl. ..... 60/39.23; 60/737; 60/740

(58) Field of Classification Search ..... 60/39.23, 60/794, 39.27, 737, 740
See application file for complete search history.

(56) References Cited

U.S. PATENT DOCUMENTS 2,655,787 A * 10/1953 Brown ..... 60/39.23
3,930,368 A * 1/1976 Anderson et al. ..... 60/39.23
4,817,389 A * 4/1989 Holladay et al. ..... 60/739
5,274,993 A * 1/1994 Keller ..... 60/39.37
5,333,459 A * 8/1994 Berger ..... 60/39.23
5,533,329 A * 7/1996 Ohyama et al. ..... 60/39.27
5,636,510 A * 6/1997 Beer et al. ..... 60/39.23
5,660,044 A * 8/1997 Bonciani et al. ..... 60/737
5,671,597 A 9/1997 Butler et al.
5,685,139 A 11/1997 Mick et al.
5,836,163 A * 11/1998 Lockyer et al. ..... 60/737
5,924,275 A 7/1999 Cohen et al.
6,038,861 A 3/2000 Amos et al.
6,098,407 A 8/2000 Korzendorfer et al.
6,209,325 B1 * 4/2001 Alkabie ..... 60/737
6,282,904 B1 9/2001 Kraft et al.
6,360,525 B1 3/2002 Senior et al.
6,446,439 B1 9/2002 Kraft et al.
6,962,055 B2 11/2005 Chen et al.
7,107,772 B2 9/2006 Chen et al.

* cited by examiner

*Primary Examiner* — Ted Kim

(57) ABSTRACT

Premix nozzles and gas turbine engine systems involving such nozzles are provided. In this regard, a representative industrial gas turbine engine includes: a combustion section having a nozzle assembly operative to provide a fuel-air mixture for combustion, the nozzle assembly having an array of shuttered nozzles and non-shuttered nozzles; each of the shuttered nozzles being operative in an open position, in which air is directed through the shuttered nozzle for mixing with fuel, and a closed position, in which a reduced amount of air is directed through the shuttered nozzle; each of the shuttered nozzles being inoperative to independently alter an amount of air being directed therethrough.

15 Claims, 2 Drawing Sheets

PREMIX NOZZLES AND GAS TURBINE ENGINE SYSTEMS INVOLVING SUCH NOZZLES

BACKGROUND

1. Technical Field

The disclosure generally relates to industrial gas turbine engines.

2. Description of the Related Art

Industrial gas turbine engines are used in a variety of applications such as power generation, for example. Oftentimes, efforts to improve the efficiency of these engines become difficult as emission requirements tend, over time, to become more stringent.

SUMMARY

Premix nozzles and gas turbine engine systems involving such nozzles are provided. In this regard, an exemplary embodiment of a premix nozzle for an industrial gas turbine engine comprises: a housing defining an interior and having an outlet communicating with the interior, the housing further having a housing opening communicating with the interior, the housing opening being operative such that air exterior to the housing is drawn into the interior of the housing through the housing opening, mixed with fuel, and directed out of the housing through the outlet; and a valve contacting the exterior of the housing and having a valve opening, the valve being movable between an open position, in which the valve opening is aligned with the housing opening such that air exterior to the housing is drawn into the interior of the housing through the valve opening and the housing opening, and a closed position, in which a reduced amount of air exterior to the housing is drawn into the interior.

An exemplary embodiment of a nozzle assembly for a combustion section of an industrial gas turbine engine comprises: an array of shuttered nozzles, each of the shuttered nozzles comprising: a housing defining an interior and having an outlet communicating with the interior, a housing opening communicating with the interior, the housing opening being operative such that air exterior to the housing is drawn into the interior of the housing through the housing opening, mixed with fuel, and directed out of the housing through the outlet; and a valve located exterior to the housing and having a valve opening, the valve being movable between an open position, in which air exterior to the housing is drawn into the interior of the housing through the valve opening and the housing opening, and a closed position, in which a reduced amount of air exterior to the housing is drawn into the interior.

An exemplary embodiment of an industrial gas turbine engine comprises: a combustion section having a nozzle assembly operative to provide a fuel-air mixture for combustion, the nozzle assembly having an array of shuttered nozzles and non-shuttered nozzles; each of the shuttered nozzles being operative in an open position, in which air is directed through the shuttered nozzle for mixing with fuel, and a closed position, in which a reduced amount of air is directed through the shuttered nozzle; each of the shuttered nozzles being operative to independently alter an amount of air being directed therethrough.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Premix nozzles and gas turbine engine systems involving such nozzles are provide, several exemplary embodiments of which will be described in detail. In this regard, some embodiments involve the use of gas actuated shutter valves for metering the flow of air entering the nozzles. In some of these embodiments, such a shutter valve incorporates ports that selectively align with corresponding ports located on a housing of the nozzle. When the ports of the valve are aligned with the ports of the housing, air can enter the interior of the nozzle and mix with the fuel.

Figure 1:
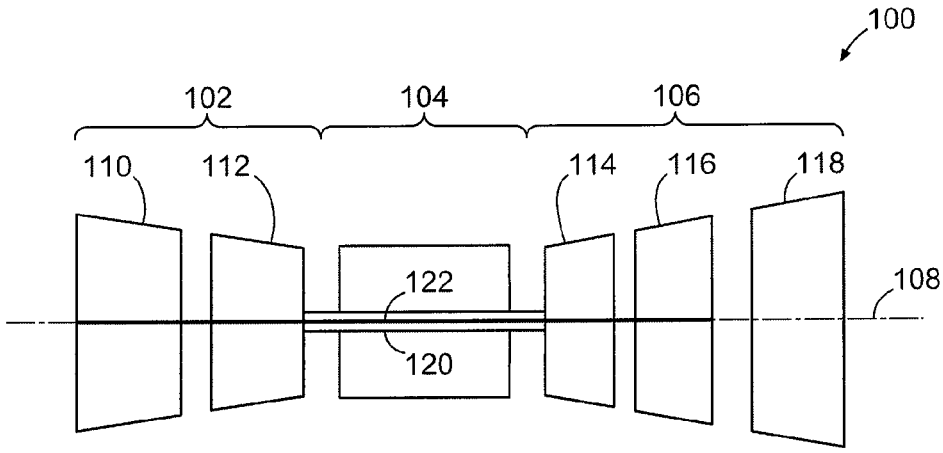
FIG. 1 is a schematic diagram of an embodiment of an industrial gas turbine engine.

Referring to the schematic diagram of FIG. 1, an exemplary embodiment of an industrial gas turbine engine is depicted. As shown in FIG. 1, engine 100 incorporates a compressor section 102, a combustion section 104 and a turbine section 106, each of which is oriented along a longitudinal axis 108. Compressor section 102 includes a low pressure compressor 110 and a high pressure compressor 112. The turbine section 106 includes a high pressure turbine 114, a low pressure compressor 116 and a power turbine 118.

In operation, a fuel-air mixture provided to combustion section 104 is combusted and directed to the high pressure and low pressure turbines. A high shaft 120 interconnects the high pressure turbine and the high pressure compressor, and a low shaft 122 interconnects the low pressure turbine and the low pressure compressor. Exhaust from the low pressure turbine is directed to power turbine 118, which is a free turbine, i.e., the power turbine is not rotated via a shaft that is interconnected with the high and/or low turbines.

Figure 2:
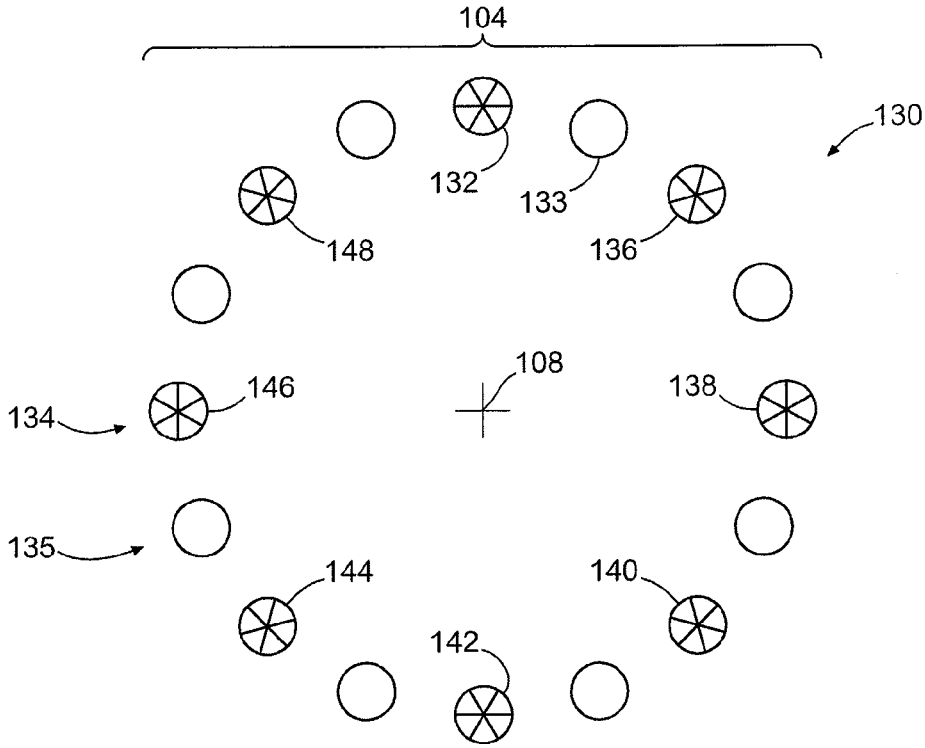
FIG. 2 is a schematic diagram of the embodiment of FIG. 1 showing orientation of premix nozzles of a nozzle assembly.

FIG. 2 schematically depicts a portion of combustion section 104. In particular, FIG. 2 depicts an annular assembly 130 of nozzles (e.g., nozzle 132) that provide fuel and air for combustion within combustion section 104. In the embodiment of FIG. 2, two types of nozzles are depicted. Specifically, shuttered nozzles (e.g., nozzle 132) and non-shuttered nozzles (e.g., nozzle 133) are provided. In the embodiment of FIG. 2, each of the nozzle types forms an array of nozzles, with the eight nozzles of the array 134 of shuttered nozzles being interleaved with the eight nozzles of the array 135 of non-shuttered nozzles. This results in the nozzles of this embodiment alternating between shuttered and non-shuttered types about the circumference of assembly 130. Notably, in other embodiments, various other numbers and/or orientations of nozzles can be used.

In operation, the non-shuttered nozzles of array 135 are used to provide fuel and air to combustion section 104 regardless of the demand for power. However, as an increase in power is requested, fuel and air is provided from the shuttered nozzles of array 134 in increasing increments that correspond to the amount of power requested. In this embodiment, each incremental increase in the metered flow of fuel and air corresponds to actuating another of the shuttered nozzles. Specifically, at 50% power, nozzle assembly 130 is controlled so that only the non-shuttered nozzles provide fuel and air for combustion. As an increase in power is requested, such as when power is requested at 56.66% power, for instance, a first shuttered nozzle is controlled so that fuel and air is now also provided from that shuttered nozzle. For each additional increment of requested power (in this case, each 6.66% increment), another shuttered nozzle is controlled to direct fuel and air. Notably, each increment in this embodiment corresponds to a 6.66% increase in power because there are eight shuttered nozzles providing additional fuel and air over a power range of 50%. In other embodiments, various other numbers and/or increments can be used.

The opening sequence of the shuttled nozzles of array 134 involves opening nozzles on opposite sides of the array sequentially in order to promote balanced combustion. By way of example, after nozzle 132 is opened, nozzle 142 is opened. Thereafter, nozzles 138, 146, 136, 144, 148 and 140 are opened in sequence. Clearly, various other opening sequences can be used in other embodiments. A representative closing sequence involves closing the nozzles sequentially, but in the reverse order.

It should be noted that in the embodiment of FIG. 2, each shuttered nozzle selectively exhibits a closed position, in which air and fuel are not provided by the nozzle for combustion, an open position, in which air and fuel are provided, or an intermediate position, in which the nozzle is transitioning between the open and closed positions. In other embodiments, shuttered nozzles can be controlled to selectively maintain one or more of a range of intermediate positions that provide varying flows of fuel and air between the flow available at the closed position (i.e., no flow) and the open position (i.e., maximum flow). In such an embodiment, one or more of the shuttered nozzles can be modulated as desired (such as responsive to a feedback signal) for distributing the fuel and air among the nozzles.

Figure 3:
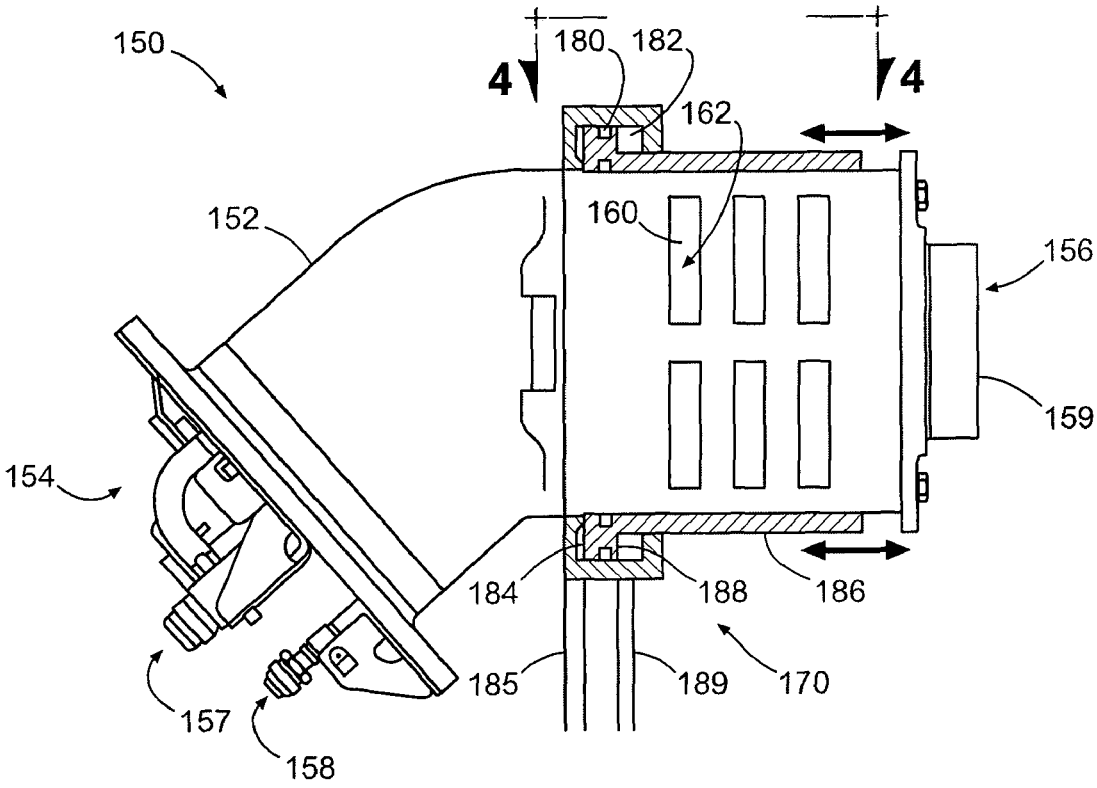
FIG. 3 is a partially cut-away view of an embodiment of a premix nozzle.

An embodiment of a shuttered nozzle is depicted in FIG. 3. As shown in FIG. 3, nozzle 150 incorporates a housing 152 that extends between an end 154 and an end 156. End 154 is used for mounting the nozzle to the combustion section of an engine and, in this embodiment, receives fuel provided by fuel lines 157, 158. Fuel and air mixed within the nozzle are expelled via an outlet 159 located at end 156. Notably, housing 152 incorporates housing openings (e.g., opening 160) that permit air to flow from the exterior of the housing to the interior 162 of the housing for mixing with the fuel.

Figure 4:
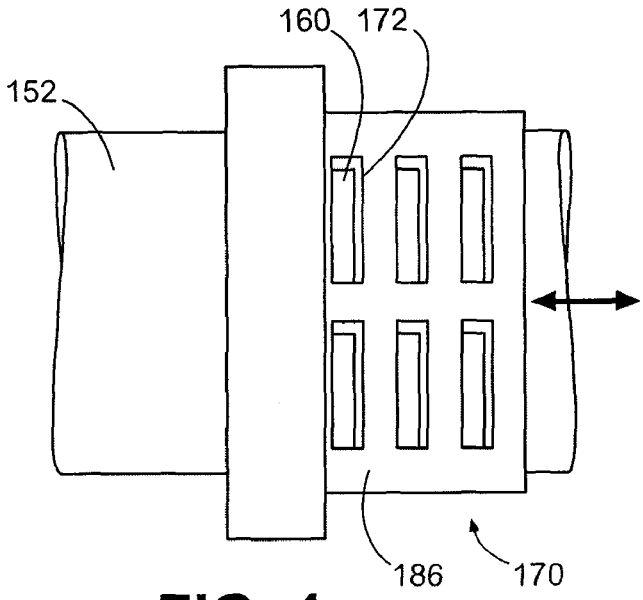
FIG. 4 is a partially cut-away view of the embodiment of FIG. 3 as viewed along line 4-4.

As shown in FIG. 4, airflow to the interior of the housing is controlled by valve 170, which also incorporates valve openings (e.g., opening 172). In the open position of the nozzle, valve 170 is controlled so that openings of the valve align with openings of the housing. In contrast, in the closed position of the nozzle, valve 170 is controlled so that openings of the valve do not align with openings of the housing, thereby restricting the flow of air into the nozzle.

In particular, when engine power reduction is required fuel is reduced. At a predetermined setting fuel is shut off to a nozzle and valve 170 is closed. Fuel is redistributed among the open nozzles (and/or partially open nozzles). Simultaneously, air also is redistributed among the nozzles that are at least partially opened. Notably, FIG. 4 depicts an intermediate position (i.e., partially opened), in which the openings of the valve are partially aligned with openings of the housing. This tends to promote lower exhaust emissions at reduced power settings.

Positioning of valve 170 is controlled by providing pressurized fluid to one side or the other of a piston head 180 that is housed within an annular cavity 182. By way of example, providing pressurized fluid to side 184 of piston head 180 via line 185 causes the piston head (and the attached piston body 186, which defines the valve openings) to move toward end 156 to achieve the open position. In contrast, providing pressurized fluid to side 188 via line 189 causes the piston head and piston body to move to the closed position.

It should be noted that the pressurized fluid can be one of a variety of fluids and, in some embodiments, may even be the same fluid used as the fuel, e.g., natural gas. In some embodiments, providing of pressurized fluid for controlling the piston position can be accomplished by use of one or more solenoids, for example.

Note also that, in the embodiment of FIGS. 3 and 4, the piston body 185 is cylindrical in shape to correspond to the exterior shape of the corresponding portion 190 of the housing. In other embodiments, various other shapes of piston bodies and housings can be used.

In some applications, shuttered nozzles, such as the exemplary embodiments described above, can be used as retrofit components on gas turbine engines. By way of example, some engines may incorporate nozzles (e.g., non-shuttered nozzles) that are not configured for selectively reducing both the amount of fuel and air provided for combustion. That is, when fuel is cut off to a nozzle, air may still be provided for combustion via that nozzle. In such an engine, at least a subset of the nozzles may be replaced using shuttered nozzles. As such, an improvement in emission quality may be exhibited as a decrease in requested power of the retrofit engine may result in fuel and air being cut off to one or more of the shuttered nozzles and redistributed to the non-shuttered nozzles.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A premix nozzle for an industrial gas turbine engine comprising:

a housing comprising a tubular valve portion, an outlet and a housing opening, the valve portion defining an axially extending interior, the outlet communicating with the interior, the housing opening communicating with the interior, and the housing opening being operative such that air exterior to the housing is drawn into the interior of the housing through the housing opening, mixed with fuel, and directed out of the housing through the outlet; and a valve contacting an exterior of the valve portion and having a valve opening, the valve being moveable between an open position, in which the valve opening is aligned with the housing opening such that air exterior to the housing is drawn into the interior of the housing through the valve opening and the housing opening, and a closed position, in which a reduced amount of air exterior to the housing is drawn into the interior; and a fluid actuator connecting the valve to the valve portion, and including at least one fluid actuation line operative to move the valve opening axially relative to the housing opening between the open position and the closed position.

2. The nozzle of claim 1, wherein the fluid is fuel.

3. The nozzle of claim 1, wherein the fluid is natural gas.

4. The nozzle of claim 1, wherein:

the valve has a piston head and a piston body; and the piston body is cylindrical.

5. The nozzle of claim 4, wherein:

the valve opening is a first valve opening of multiple valve openings; and the multiple valve openings are oriented in an annular array about the piston body.

6. The nozzle of claim 1, wherein:

the tubular valve portion comprises a cylindrical portion terminating at an end; and the outlet is located at the end.

7. The nozzle of claim 6, wherein:

the housing opening is a first housing opening of multiple housing openings; and the multiple housing openings are oriented in an annular array about the cylindrical portion of the housing.

8. The nozzle of claim 1, wherein the housing receives one or more fuel lines.

9. A nozzle assembly for a combustion section of an industrial gas turbine engine comprising:

an array of shuttered nozzles, each of the shuttered nozzles comprising:

a housing comprising a tubular valve portion, an outlet and a housing opening, the valve portion defining an axially extending interior, the outlet communicating with the interior, the housing opening communicating with the interior, and the housing opening being operative such that air exterior to the housing is drawn into the interior of the housing through the housing opening, mixed with fuel, and directed out of the housing through the outlet; and a valve located exterior to the valve portion and having a valve opening, the valve being moveable between an open position, in which air exterior to the housing is drawn into the interior of the housing through the valve opening and the housing opening, and a closed position, in which a reduced amount of air exterior to the housing is drawn into the interior; and a fluid actuator connecting the valve to the valve portion, and including at least one fluid actuation line operative to move the valve opening axially relative to the housing opening between the open position and the closed position.

10. The nozzle assembly of claim 9, further comprising an array of non-shuttered nozzles operative to receive fuel and air and to mix the fuel and air or combustion.

11. The nozzle assembly of claim 10, wherein:

the array of shuttered nozzles is an annular array; and the array of non-shuttered nozzles is an annular array.

12. The nozzle assembly of claim 10, wherein:

each of the non-shuttered nozzles is located between a corresponding adjacent pair of the shuttered nozzles; and each of the shuttered nozzles is located between a corresponding adjacent pair of the non-shuttered nozzles.

13. The nozzle assembly of claim 10, wherein the nozzle assembly is operative such that fuel is provided to the non-shuttered nozzles and not to the shuttered nozzles during operation unless a request for increased power corresponding to a first threshold is received and responsive to which, the nozzle assembly provides fuel to at least a first of the shuttered nozzles.

14. The nozzle assembly of claim 10, wherein the nozzle assembly is operative such that fuel is provided to the non-shuttered nozzles and to the shuttered nozzles during operation unless a request for decreased power corresponding to a first threshold is received and responsive to which, the nozzle assembly ceases providing fuel to at least a first of the shuttered nozzles.

15. The nozzle assembly of claim 9, wherein the housing receives one or more fuel lines.

* * * * *